US008047745B2

(12) United States Patent
Heindl

(10) Patent No.: US 8,047,745 B2
(45) Date of Patent: Nov. 1, 2011

(54) CONNECTION ELEMENT AND A SHEET PILE WALL HAVING SUCH A CONNECTION ELEMENT

(75) Inventor: Richard Heindl, Munich (DE)

(73) Assignee: Pilepro, LLC, Austin, TX (US)

( * ) Notice: Subject to any disclaimer, the term of this patent is extended or adjusted under 35 U.S.C. 154(b) by 380 days.

(21) Appl. No.: 12/381,258

(22) Filed: Mar. 10, 2009

(65) Prior Publication Data

US 2009/0226664 A1 Sep. 10, 2009

(30) Foreign Application Priority Data

Mar. 10, 2008 (DE) ..... 10 2008 013 443

(51) Int. Cl.
*E02D 5/00* (2006.01)

(52) U.S. Cl. ..... 405/279; 405/278; 405/281

(58) Field of Classification Search ..... 405/278, 405/279, 281
See application file for complete search history.

(56) References Cited

U.S. PATENT DOCUMENTS 4,808,039 A * 2/1989 Fischer ..... 405/281

FOREIGN PATENT DOCUMENTS

EP 1688544 A1 2/2005
FR 2648493 * 12/1990

* cited by examiner

*Primary Examiner* — John Kreck
*Assistant Examiner* — Sean Andrish
(74) *Attorney, Agent, or Firm* — Karl F. Milde, Jr.; Eckert Seamans Cherin & Mellott, LLC

(57) ABSTRACT

A connection element for light profiles in a sheet pile wall has a base strip (12) for attaching to a component of the sheet pile wall and a hook strip (14) provided at the flat side of the base strip (12) for engaging the interlock (32) of a light profile (30). The hook strip (14) that encloses an inner chamber (16) exhibits a straight connection section (20) that originates at the base strip (12) and runs at least approximately at a right angle to the longitudinal direction of the base strip (12) and a hook section (22) that follows the connection section (20) and runs in an arc-like manner for at least 180°, with the free end of said hook section (22) together with the flat side of the base strip (12) defining a jaw (28). According to the invention, the ratio between the greatest inner width (a) of the inner chamber (16) of the hook strip (14) to the width (c) of the opening jaw (28) is in a range between 2.6 and 2.9.

20 Claims, 8 Drawing Sheets

CONNECTION ELEMENT AND A SHEET PILE WALL HAVING SUCH A CONNECTION ELEMENT

BACKGROUND OF THE INVENTION

The invention relates to a connection element for light profiles intended for use in a sheet pile wall, the connection element having a base strip for attaching to a component of the sheet pile wall and a hook strip provided at the flat side of the base strip for engaging the interlock of a light profile, whereby the hook strip that encloses an inner chamber exhibits a straight connection section that originates at the base strip and runs at least approximately at a right angle to the longitudinal direction of the base strip, and a hook strip that follows the connection section and runs in an arc-like manner for at least 180°, where the end of said hook strip together with the flat side of the base strip define a jaw. The invention also relates to a sheet pile wall made of light profiles and potentially of provided carrier elements, whereby at least two light profiles and/or at least one light profile and one carrier element are connected to each other by such a connection element.

For some time now, sheet pile walls are also erected made of so-called light profiles. Light profiles are sheet piles that—in contrast to conventional sheet piles—are made by cold rolling. Due to the manufacturing process, only sheet piles with relatively thin walls can be manufactured, limiting the production of interlocks for connecting the light profiles to each other or even with other components of the sheet pile wall to simple interlock configurations. The term "other components of the sheet pile wall" refers, among others, to carrier elements, such as I-beams, T-beams, tubular piles and the like, hot-rolled sheet piles or also additional light profiles. To achieve a flexibility when erecting the sheet pile walls that is comparable to conventional sheet pile walls, the inventor of the connection element described here has also developed connection elements that can be used to connect light profiles with differently designed sheet pile wall components, such as carrier elements, for example I-beams, T-beams, tubular piles and similar elements.

With the known connection elements for light profiles as described in EP 1 688 544 A1, the connection element is provided with a hook strip for engaging the interlock of the light profile, where the hook strip exhibits a connection section that protrudes from the base strip of the connection element and that is followed by a hook section that runs 180° in the shape of an arc and with its free end defines a jaw together with the flat side of the base strip. As has been shown that in principle this described basic shape of the hook strip is suited for engaging the interlocks of light profiles. However, light profiles are characterized by a multitude of variations, for example in the wall thickness of the light profiles, such that the known connection elements encountered problems when using connection elements for light profiles made by different manufacturers or with different dimensions.

SUMMARY OF THE INVENTION

It is, therefore, the objective of the invention to provide a connection element for light profiles in a sheet pile wall, or to provide a sheet pile wall that contains light profiles, which allows the use of light profiles of various manufacturers or with various dimensions for the application of said sheet pile walls or when applying the connection elements according to the invention.

According to the invention, this objective is realized by setting the ratio between the greatest inner width of the inner chamber of the hook strip viewed in the parallel direction to the longitudinal direction of the connection section to the greatest width of the jaw between the free end of the hook section and the flat side of the base strip, as viewed in the parallel direction to the longitudinal direction of the connection section, to be in a range between 2.6 and 2.9.

The connection element according to the invention provides a sufficiently large contact surface for the interlock of the light profile that engages with the hook strip while at the same time the hook strip exhibits a jaw that is dimensioned such that interlocks of various light profiles made by various manufacturers can be hung and yet designed sufficiently narrowly that an unintentional separation of the interlocks from the hook strip is prevented. According to the invention, this is achieved by specifying the ratio between the inner width of the inner chamber of the hook strip and the greatest width of the jaw as having a value in a range between 2.6 and 2.9. Test series have shown that when maintaining this ratio, the contact surface for the interlock of the light profile that engages with the hook strips provides sufficient support for the interlocks of the various light profiles in the connection element, even for differently dimensioned and differently designed interlock configurations. At the same time, the jaw of the hook strip is dimensioned such that interlocks of different light profiles can pivot in a range of ±25° while at the same time effectively preventing disengagement of the interlocks from the hook strips. Only when using the connection elements according to the invention is it possible to employ light profiles in the same manner as conventional hot-rolled sheet piles such that sheet pile walls can be erected with light profiles and carrier elements such as I-beams, T-beans or tubular piles.

The connection element according to the invention is manufactured by extrusion molding; however, it can also be manufactured by hot or cold rolling.

For example, it has proven to be particularly advantageous for the ratio between the greatest inner width of the inner chamber and the greatest width of the jaw to be at 2.75. Surprisingly, it has shown that when maintaining this ratio, the largest number of different light profiles available on the market can be coupled with the connection element according to the invention.

It is furthermore recommended to correlate the greatest width of the jaw, and thus indirectly also the greatest inner width of the inner chamber, with the material thickness of the hook section perpendicular to the longitudinal direction of the hook section. In this manner, by integrating the material thickness of the hook section, a direct correlation between the section modulus of the connection element and the dimensioning of the hook strip is established. It has shown to be particularly advantageous if the ratio between the material thickness of the hook section viewed perpendicular to the longitudinal direction of the hook section and the greatest width of the jaw is in a range from 0.4 to 0.8, preferably at 0.6. Maintaining this ratio on the one hand ensures a sufficient section modulus for the light profiles to be hung while on the other hand retains the desired flexibility when using light profiles of different manufacturers and of different dimensions.

To ensure that the interlock of the light profile that engages in the hook strip does not disengage from the hook strip even in extreme installation positions, it is additionally recommended that the ratio of the greatest inner width of the inner chamber to the greatest width of the inner chamber viewed perpendicular to the longitudinal direction of the connection section is in a range between 2.3 and 2.5 preferably at 2.4.

Compared to the state-of-the-art, this achieves a long and at the same time slim dimensioning of the inner chamber of the hook strip that is accompanied by a good support of the interlock and allows also for taking up long dimensioned interlocks.

With one particularly advantageous embodiment of the connection element according to the invention, the hook section is formed of one first arc-shaped section that directly follows the connection section and exhibits a uniform smaller inner curvature radius and a second arc-shaped section that follows said first section and exhibits a uniform greater inner curvature radius, where the ratio between the greater inner curvature radius and the smaller inner curvature radius is in a range between 4.1 and 4.4, preferably at 4.25. The result of the lightly curved contour of the second section of the hook strip is that the interlocks that engage in the hook strip are always supported at the curved inner side of the second section, regardless of slight differences in the dimensions of the interlocks. At the same time, the connection element according to the invention also takes into account the dimension of the hook strip itself through the correlation between the designs of the first arc-shaped section, in particular its curvature radius, and the design of the second arc-shaped section.

With this design, it is of particular advantage when the more than 180° arc-shaped contour of the hook strip is achieved, with the first arc-shaped section exhibiting an arc length having a maximum of 165° and the second arc-shaped section an arc length having a maximum of 65°. This achieves that, here also the design of the first arc-shaped section directly influences the design of the second arc-shaped section, creating a protracted arc as the hook section.

To achieve a stress pattern at the transition from the base strip into the connection section of the hook strip that is as uniform as possible, it is recommended in one particularly advantageous embodiment of the connection element according to the invention that the base strip transitions into the connection section at its inside that defines its inner chamber under formation of a radius. It is of particular advantage if the nominal value of the radius corresponds at least approximately to the nominal value of the width of the jaw. Dimensioning the radius and the width of the jaw equally ensures a sufficient freedom to pivot for the interlock of the engaged light profile.

Preferably, the radius at the transition of the base strip into the connection section of the hook strip is 2.0 to 2.5 times the smaller inner curvature radius of the first arc-shaped section.

In another particular advantageous embodiment of the connection element according to the invention, it is designed as a weld-on profile, where the rear side of the base strip that points away from the hook strip serves as a weld-on surface for welding to a component of the sheet pile wall, for example for welding to the lateral surface area of a tubular pile, whereby the weld-on surfaces are provided at the longitudinal edges of the base strip, preferably with two additional weld-on elevations that run parallel to each other and extend across the entire length of the connection element, additionally facilitating the welding procedure.

If the connection element is to be attached by welding at a plane surface, for example at the end of the crossbeam of an I-beam, it is recommended to design the connection element as a weld-on profile, where a weld-on strip protrudes at an at least approximately right angle from the back side of the base strip that points away from the hook strip and extends preferable originating at one of the two longitudinal edges of the base strip. The connection element according to the invention can then be placed with the weld-on strip onto that surface, where the connection element is to be welded.

If the connection element according to the invention is to be connected to an additional sheet pile wall component that is not designed as a light profile, it is further recommended to provide the connection element at the back side of the base strip that points away from the hook strip with a connection profile for connecting to the component, for example a carrier element of the sheet pile wall.

If the sheet pile wall component to which the connection element is to be attached is a carrier element with a fastening section exhibiting a rectangular cross-section, two holding strips are provided as attachment profiles that protrude at least approximately at a right angle from the base strip, arc at a distance from each other and between which the fastening section of the carrier element is to be inserted for fastening purposes.

If, on the other hand, the fastening section expands towards its free end and towards the outside in a wedge-shaped manner, then the connection element is provided with an attachment profile, which exhibits a first support strip that protrudes from the base strip at an angle of less than 90° and a second support strip at a certain distance from the first protruding from the base strip at least approximately at a right angle, between which the fastening section of the carrier element is to be inserted.

In still another preferred embodiment of the connection element according to the invention, the connection element is used to connect two light profiles under an angle of approximately 90°. To this end, the connection element at this embodiment is provided with a second base strip that protrudes at least approximately at a right angle from the flat side of the first base strip that points away from the first hook strip. Provided at the free end of the second base strip is a second hook strip that is designed at least approximately identical to the first hook strip and that has a jaw defined by the flat side of the second base strip.

With one particularly advantageous development of this embodiment of the connection element according to the invention, the one free end of the first base strip transitions into the connection section of the first hook strip while the other free end of the first base strip transitions into the second base strip, preferably by forming a radius. The jaw of the second hook faces the flat side of the first base strip that points away from the first hook strip. In this manner, a particularly compact and thus dimensionally stable connection element can be provided.

If two light profiles are to be connected to each other in one plane, two hook strips are provided in an additional preferred embodiment of the connection element according to the invention, where the one free end of the first base strip transitions into the connection section of the first hook strip while the connection section of a second hook strip that is designed at least approximately identical to the first hook strip protrudes from the flat side of the base strip that points away from the first hook strip at least approximately at a right angle. The jaw of the first hook strip is defined by the free end of its hook section and by the base strip that it shares with the first hook strip.

With this development of the connection element according to the invention, the connection section of the second hook strip is provided at the base strip offset from the connection section of the first hook strip preferably in such a manner that the two light profiles that are to be hung into the two hook strips run at least approximately in one plane.

If the interlocks of the light profiles are arranged in relation to each other such that the interlocks extend in opposite directions, then one variation of the embodiment of the connection element according to the invention described above is used, where the jaw of the first hook strip and the jaw of the second hook strip open in opposite directions. Alternatively, the two jaws can also open pointing in the same direction, with the two connection sections of the two hook strips protruding in the same plane from the base strip, i.e., are designed mirror-symmetrical to each other.

It is furthermore possible to design the embodiments of the connection elements according to the invention described above and their developments for connecting three light profiles. With this embodiment, the base strip of the connection element is extended beyond the connection section of the second hook strip and forms the connection section of third hook strip that is designed at least approximately identical to the first and second hook strip, whereby the jaw of the third hook strip is formed by the free end of its hook section and the flat side of the connection section of the second hook strip that points away from the hook section of the second hook strip.

As has already been stated, the first, second and potentially provided third hook strips are designed at least approximately identical. This means that the second and third hook strips are designed at least approximately identical in their dimensions to the respective dimensions of the first hook strip, for example the greatest inner width of the inner chamber, the width of the jaw, the greatest width of the inner chamber or the various radii. However, slight dimensional deviations can exist between the two hook strips if this appears advantageous.

In order to prevent the interlock from slipping out of the hook strip, in particular when using light profiles with thin walls, it is furthermore recommended to equip the connection element according to the invention at its base strip with a support strip that protrudes at least approximately at a right angle from said base strip and that protrudes at a distance from the jaw of the hook strip in the same direction as the hook strip.

According to another aspect, the invention also relates to a sheet pile wall made of light profiles and potentially of carrier elements arranged between them, whereby at least two light profiles and/or at least one light profile and one carrier element are connected to each other by a connection element according to the invention.

DESCRIPTION OF THE PREFERRED EMBODIMENTS

Figure 1:
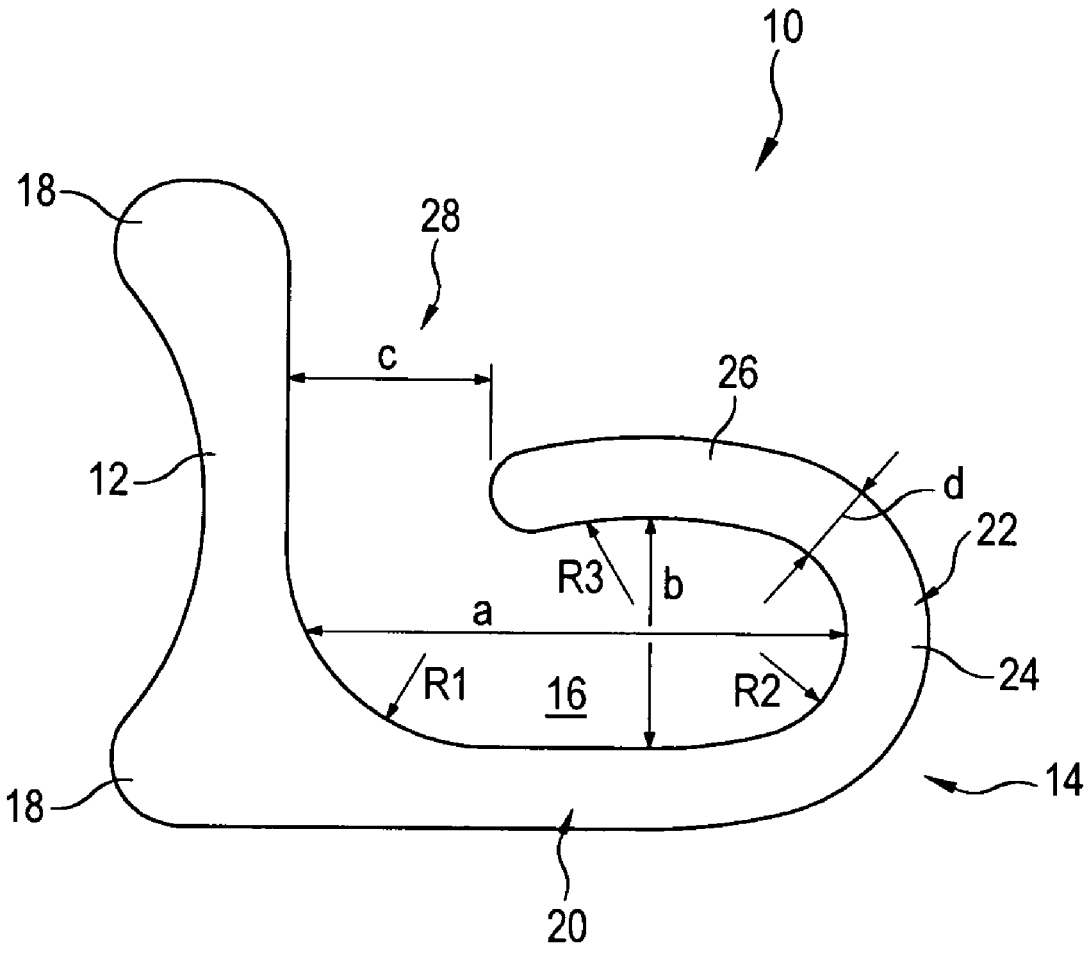
FIG. 1 shows a magnified top view of the face side of a first preferred embodiment of a connection element according to the invention, which is designed as a weld-on profile with a hook strip.

FIG. 1 shows a top view of the front face of a first preferred embodiment of a connection element 10 according to the invention. Viewed across its length, the connection element 10 has a uniform cross-section and is designed as a weld-on profile.

The connection element 10 features a base strip 12 with a hook strip 14 protruding at least approximately at a right angle from the longitudinal edge of said base strip as shown at the bottom of FIG. 1 and enclosing together with the base strip 12 an inner chamber 16. Two weld-on elevations 18 are provided at the back side of the base strip 12 that points away from the hook strip 14 and transitions into the respective longitudinal edge of the base strip 12.

The hook strip 14 features a straight connection section 20 that transitions flush into the longitudinal edge of the base strip 12 and that transitions at its end into an arc-shaped hook section 22. The inner side of the base strip 12 that defines the inner chamber 15 transitions into the connection section 20 under formation of a radius R1.

The hook section 22 is formed of one first arc-shaped section 24 that directly follows the connection section 20 and exhibits a uniform smaller inner curvature radius R2 and a second arc-shaped section 26 that follows said first section and exhibits a uniform greater inner curvature radius R3. In the shown preferred embodiment, the ratio between the greater inner curvature radius R3 to the smaller inner curvature radius R2 is at 4.25. The arc length of the first arc-shaped section 24 is at 155° while the arc length of the second arc-shaped section 26 exhibits an arc length of 45° to 50°.

Due to the design of the two arc-shaped sections 24 and 26, the end of the hook strip 14 points to the flat side of the base strip 12 and defines with it a jaw 28 for engaging the interlock of a light profile, as will be explained below, whereby the hook strip 14 exhibits a slightly curved contour and is slightly curved in the direction of the connection section 20.

The inner chamber 16 of the hook strip 14 is dimensioned such that the ratio of the greatest inner width a of the inner chamber 16 to the largest width b of the inner chamber 16 viewed perpendicular to the longitudinal direction of the connections section 20 is at 2.4 in the preferred embodiment shown.

The jaw 28 of the hook strip 14 in turn is dimensioned such that the ratio between the greatest inner width a of the inner chamber 16 of the hook strip 14 viewed in the parallel direction to the longitudinal direction of the connection section 20 to the width c of the jaw 28 between the free end of the hook section 22 and the flat side of the base strip 12 viewed in the parallel direction to the longitudinal direction of the connection section 20 is at 2.75 in the shown preferred embodiment.

The width c of the jaw 28 is adjusted to the material thickness d of the hook section 22, whereby the ratio between the material thickness d of the hook section 22 viewed perpendicular to the longitudinal direction of the hook section 22 and the greatest width c of the jaw 28 is at 0.6 in the shown preferred embodiment, while the nominal value of the radius R3 with which the base strip 12 transitions into the connection section 20 corresponds at least approximately to the nominal value of the width c of the jaw, which is at 15 mm in the shown preferred embodiment.

As is shown below with reference to FIGS. 2*a* to 2*c* as well as 3*a* to 3*c*, the design of the hook strip 14 according to the invention allows for differently dimensioned light profiles 30 with differently designed interlocks 32 to engage in the hook strip 14, preventing on the one hand a separation of the locks 32 or 34 from the hook strip 14 and on the other hand allows for pivoting angles of up to 25°.

Figure 2A:
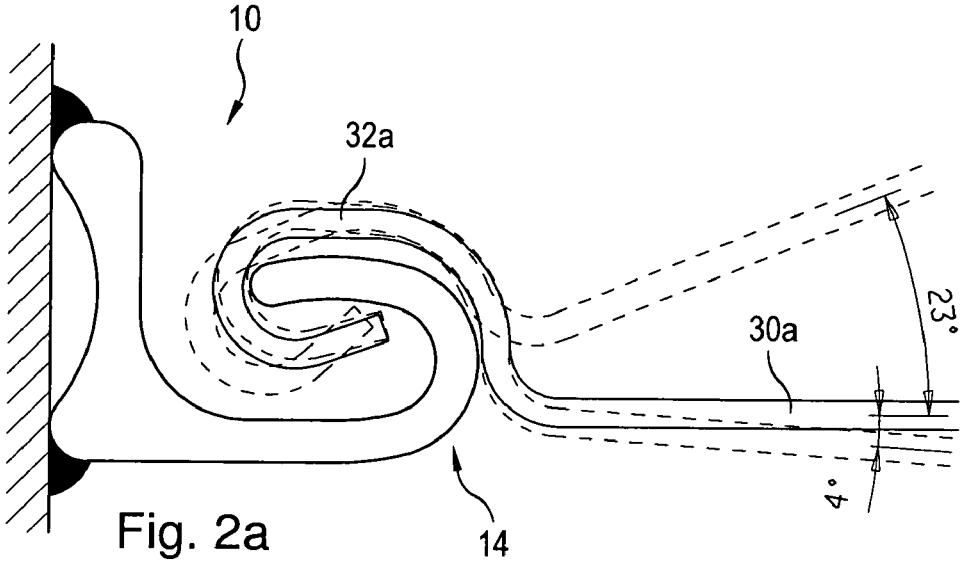
FIGS. 2*a* to 2*c* show three top views of the connection profile shown in FIG. 1 with light profiles engaging in each of them with an angulated interlock and a wall thicknesses of 4 mm, 5 mm and 7 mm, whereby each time the maximum possible pivoting angles of the light profiles are stated.
Figure 2B:
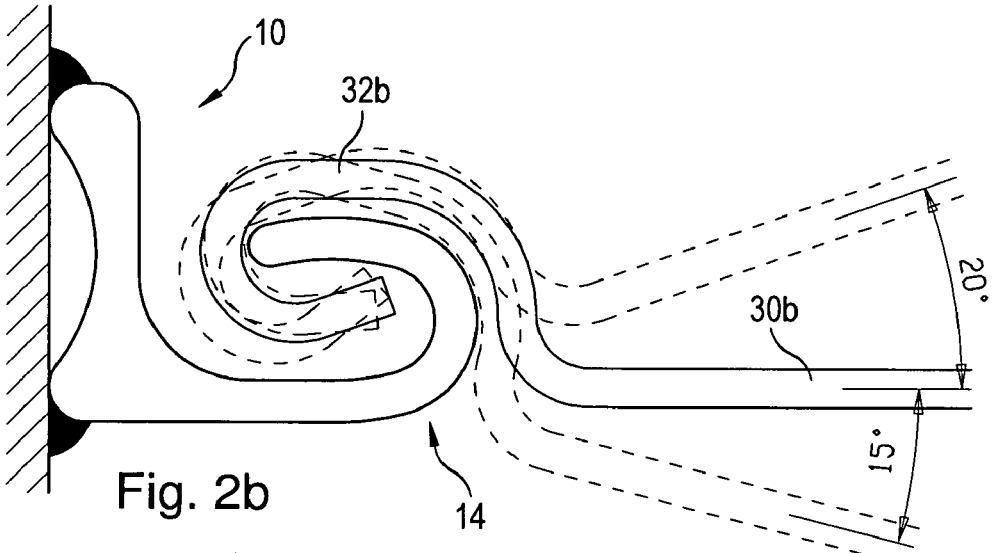
Figure 2C:
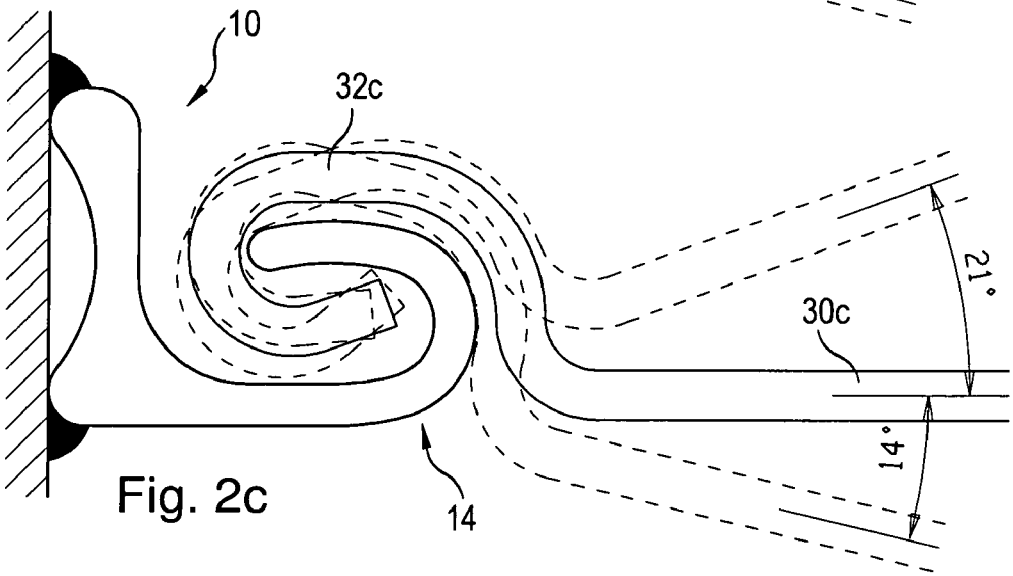

In FIGS. 2*a* to 2*c*, the angulated interlocks 32*a*, 32*b* and 32*c* of the light profiles 30*a*, 30*b* and 30*c* engage in the connection element 10, which is welded to a plane surface, with the light profiles 30*a*, 30*b* and 30*c* being dimensioned differently.

The light profile 30*a* has a material thickness of 4 mm and can pivot in one direction by up to 23° and in the other direction by 4°.

The light profile 30 shown in FIG. 2*b* has a material thickness of 5 mm and can pivot in one direction by up to 20° and in the other direction by 15°.

The light profile 30*c* shown in FIG. 2*c* has a material thickness of 7 mm and can pivot in one direction by up to XX° and in the other direction by YY'.

Figure 3A:
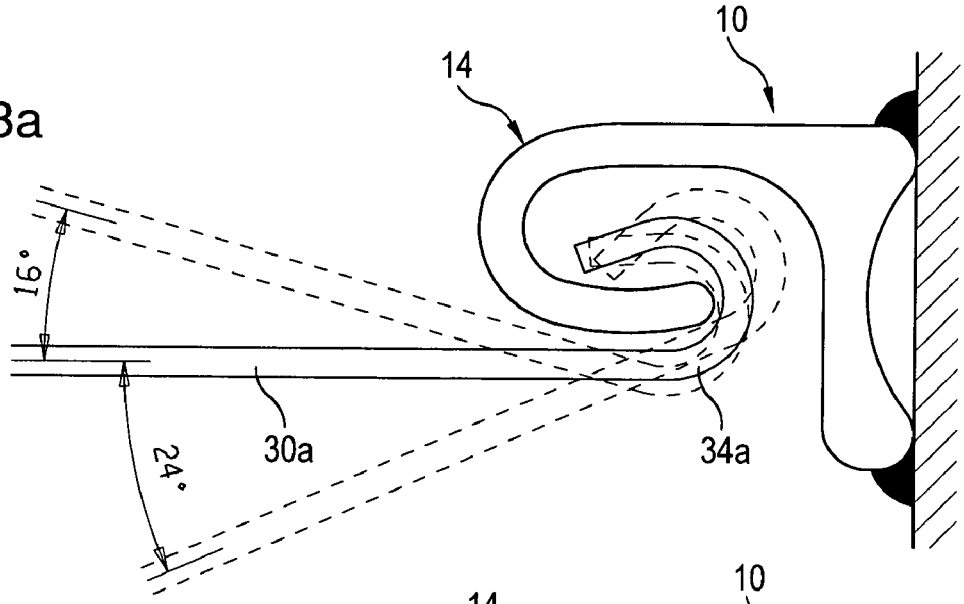
FIGS. 3*a* to 3*c* show three top views of the connection profile shown in FIG. 1 with light profiles engaging in each of them with a straight interlock and a wall thicknesses of 4 mm, 5 mm and 7 mm, whereby each time the maximum possible pivoting angles of the light profiles are stated.
Figure 3B:
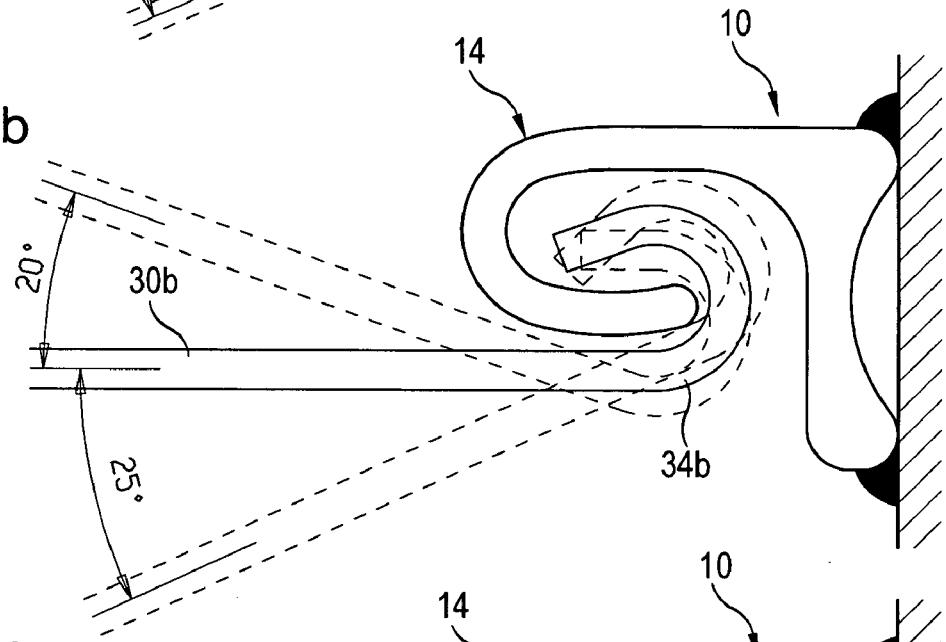
Figure 3C:
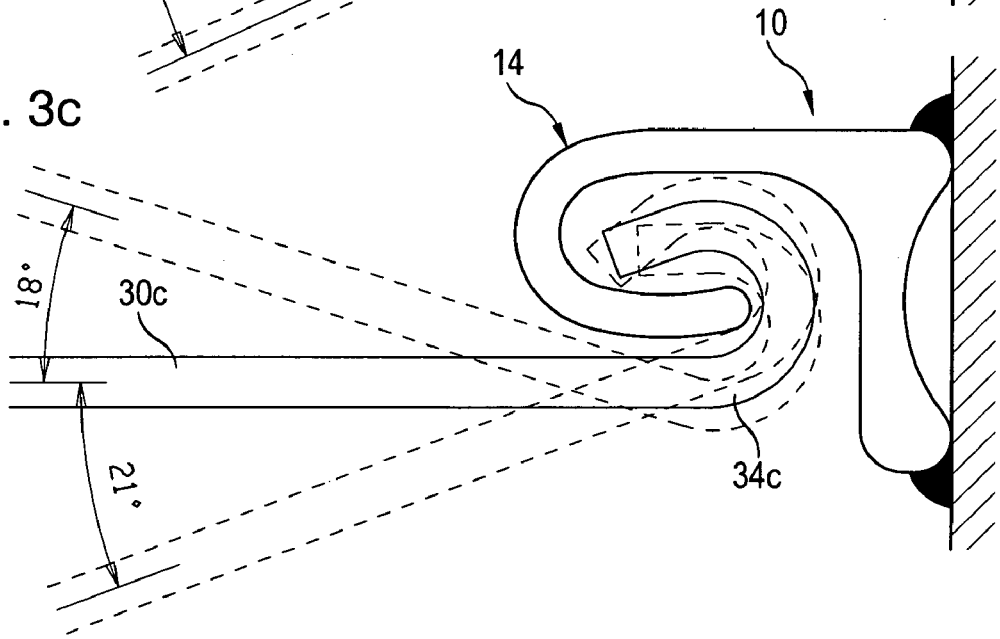

In FIGS. 3*a* to 3*c*, the connection element 10 engages with the straight interlocks 34*a*, 34*b* and 34*c* of the light profiles 30*a*, 30*b* and 30*c*.

This results in max. pivoting angles of 16° or 24° (FIG. 3*a*), of 20° and 25° (FIG. 3*b*) or of ZZ° and QQ° (FIG. 3*c*).

As FIGS. 2*a* to 2*c* and 3*a* to 2*c* show, differently dimensioned light profiles 30*a*, 30*b* and 30*c* with differently designed interlocks 32*a*, 32*b* and 32*c* or 34*a*, 34*b* and 34*c* can be hung in the hook strip 14 without the interlocks 32*a*, 32*b* and 32*c* or 34*a*, 34*b* and 34*c* separating yet retaining their ability to pivot.

Figure 4:
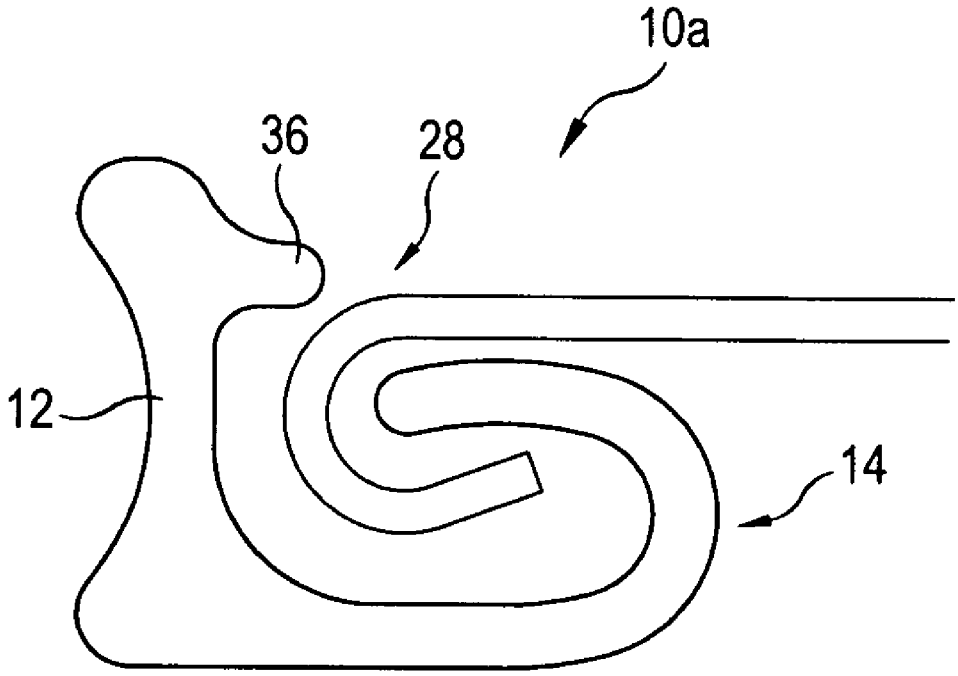
FIG. 4 shows a top view of the front face of a first modification of the connection element shown in FIG. 1, where an additional support strip is provided.

FIG. 4 shows a top view of a first variation 10*a* of the connection element 10 shown in FIG. 1, that differs from the preferred embodiment shown in FIG. 1 only in that a support strip 36 protrudes from the base strip 12 approximately at a right angle in the direction of the hook strip 14 and is arranged at a distance from the jaw 28. In particular, using the support strip 36 shall prevent a separation of the interlock 34 from the hook strip 14.

Figure 5:
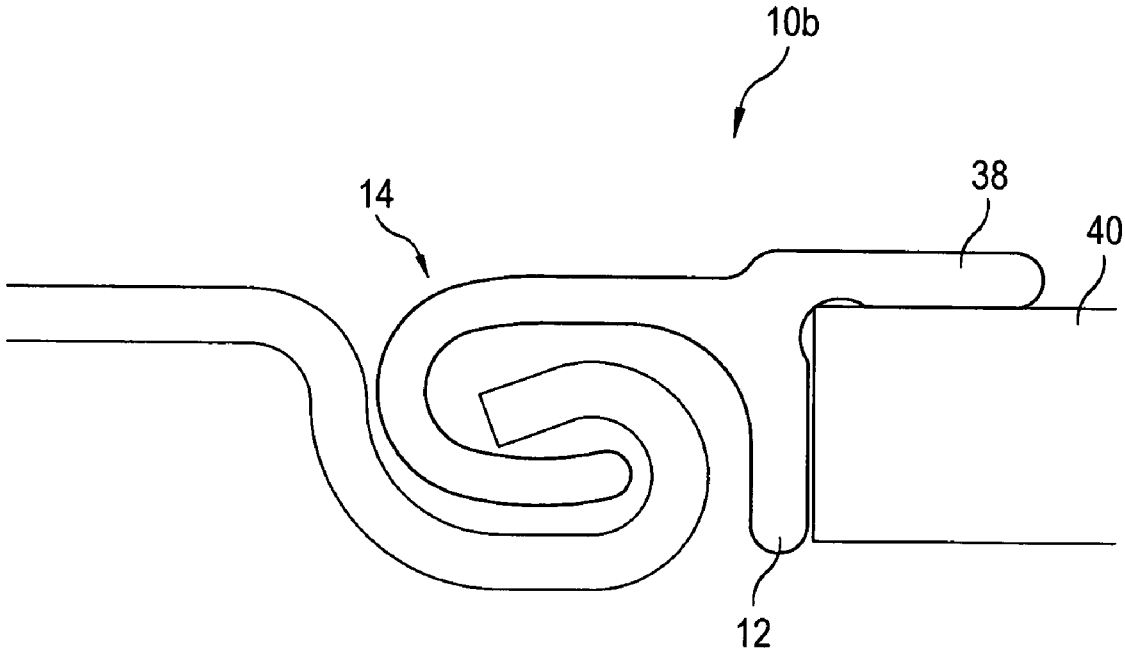
FIG. 5 shows a top view of the face side of a second modification of the connection element shown in FIG. 1 with an additional weld-on strip that is welded to the cross beam of a T-beam.

FIG. 5 shows a top view of a second variation 10*b* of the connection element 10 shown in FIG. 1. With this variation 10*b*, a weld-on strip 38 is provided at the back side of the base strip 12 that points away from the hook strip 14. The weld-on strip 38 transitions into the longitudinal edge of the base strip 12, and that at the level of the connection section 20. Using the weld-on strip 38, this variation 10*b* can be fastened without any problems at a fastening section 40 of an additional sheet pile wall component, for example a cross beam of an I-beam.

Figure 6:
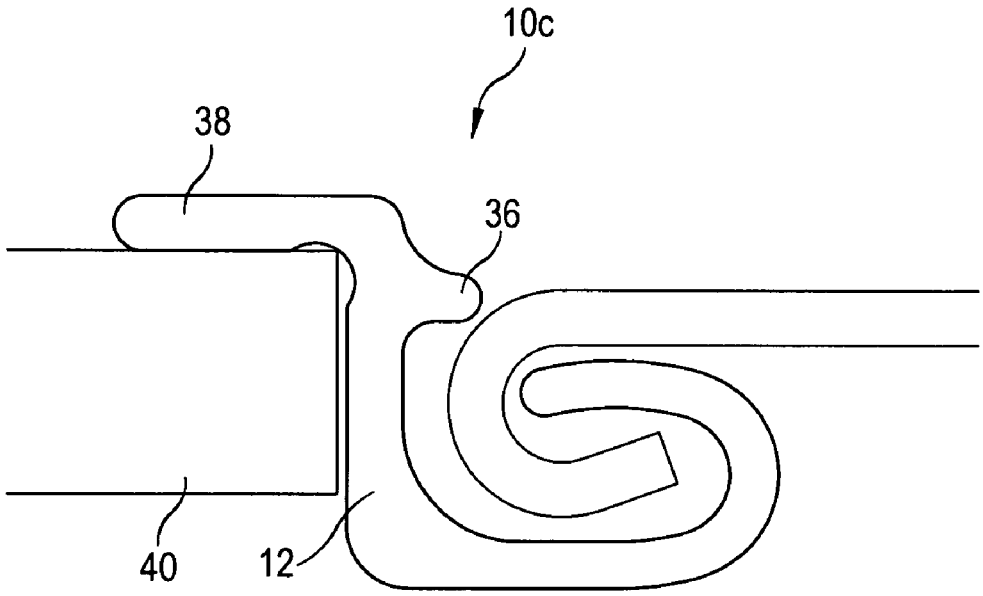
FIG. 6 shows a top view of the face side of a third modification of the connection element shown in FIG. 1 that is equipped with a weld-on strip provided at the other longitudinal edge of the connection element and with an additional support strip.

FIG. 6 shows a top view of a third variation 10*c* of the connection element 10 shown in FIG. 1. With this variation 10*c*, the weld-on strip 38 is provided at the opposite longitudinal edge of the base strip 12, whereby additionally, as is the case with the first variation 10*a* shown in FIG. 4, a support strip 36 protrudes from the base strip 12 in the direction of the hook strip 14.

Figure 7:
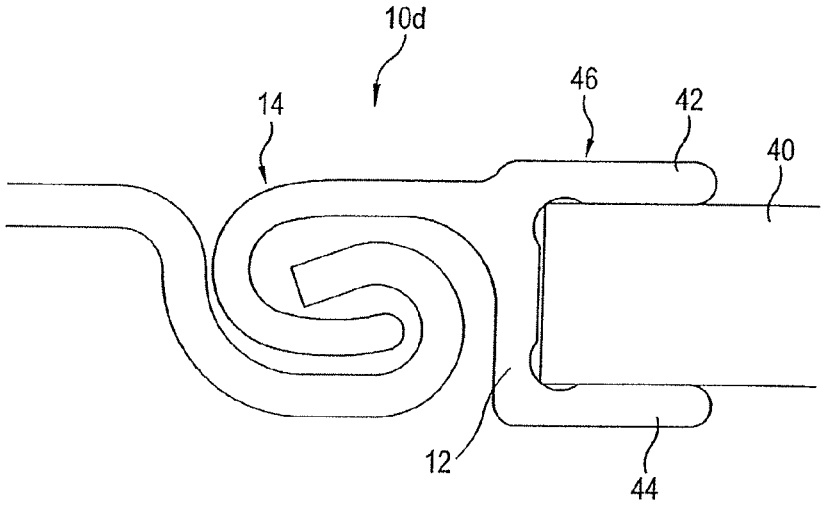
FIG. 7 shows a top view of the front face of a fourth modification of the connection element shown in FIG. 1, at which an attachment profile for engaging in a cross beam of a T-beam that is rectangular in its cross-section is provided.

FIG. 7 shows a top view of a fourth variation 10*d* of the connection element 10 shown in FIG. 1. With this variation 10*d*, two holding strips 42 and 44 that each transition into the two longitudinal edges of the base strip 12 protrude at an at least approximately right angle from the back side of the base strip 12 that points away from the hook strip 14. The holding strips 42 and 44 form an attachment profile 46, in which a fastening section 40 with a rectangular cross-section and of a sheet pile wall component can be inserted for fastening purposes.

Figure 8:
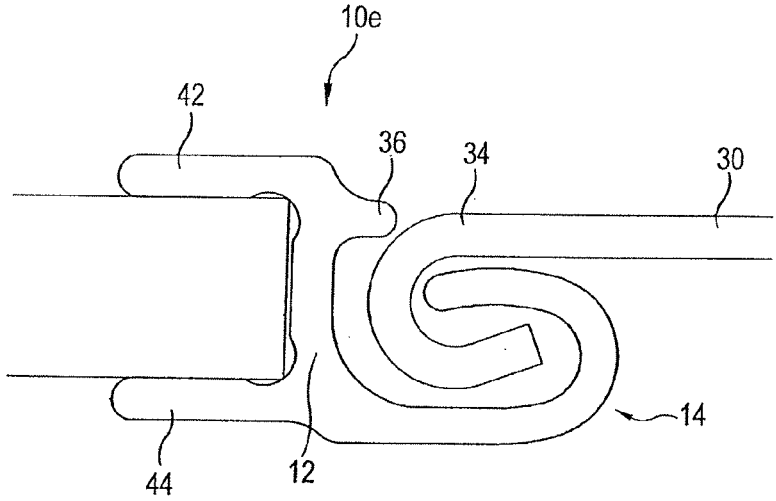
FIG. 8 shows a top view of a front face of a fifth modification of the connection element according to the invention, which essentially corresponds to the modification shown in FIG. 7 and is supplemented with an additional support strip.

FIG. 8 shows a top view of a fifth variation 10*e* of the connection element 10 shown in FIG. 1. This variation 10*e* differs from the variation 10*d* shown in FIG. 7 only in that a support strip 36 is provided additionally.

Figure 9:
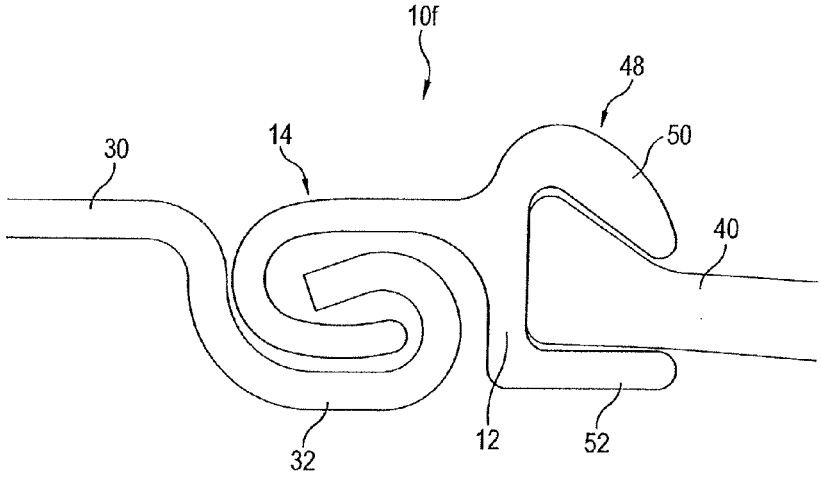
FIG. 9 shows a top view of the front face of a sixth modification of the connection element shown in FIG. 1, where an attachment profile is provided for engaging in a wedge-like expanding cross beam of a T-beam.

FIG. 9 shows a top view of a sixth variation 10*f* of the connection element 10 shown in FIG. 1. With this variation 10*f*, a connection profile 48 is provided at the back side of the base strip 12 that points away from the hook strip 14. The connection profile 48 exhibits a first holding strip 50 that protrudes from the base strip 12 at a specified angle of less than 90° and at a distance from it a second holding strip 52 that protrudes from the base strip 12 at least approximately at a right angle. The connection profile 48 is used to fasten a fastening section 40 of a sheet pile wall component, for example a cross beam of a club-shaped carrier that expands in its cross-section toward the outside in a wedge-shaped manner, with said fastening section being inserted into the connection profile 48 for fastening purposes.

Figure 10:
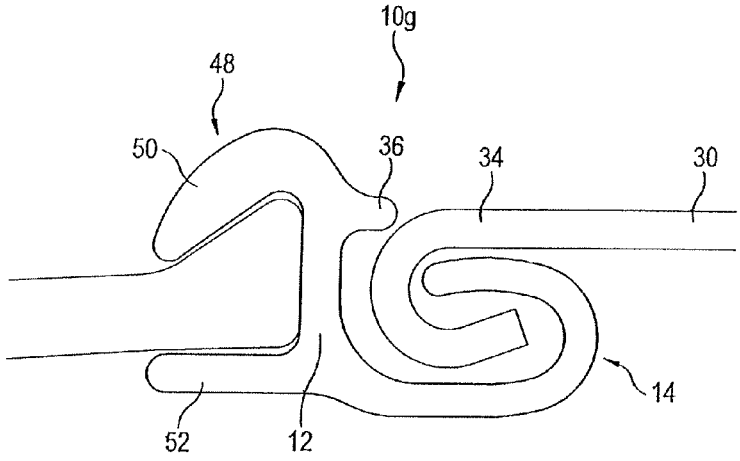
FIG. 10 shows a top view of a front face of a seventh modification of the connection element according to the invention that is similar to the modification shown in FIG. 9, where, however, the connection profile is designed mirror-inverted and is supplemented with an additional support strip.

FIG. 10 shows a seventh variation 10*g* of the connection element 10 shown in FIG. 1, where the connection profile 48 is provided mirror-symmetrical at the base strip 12 and where in addition a support strip 36 is provided.

Figure 11:
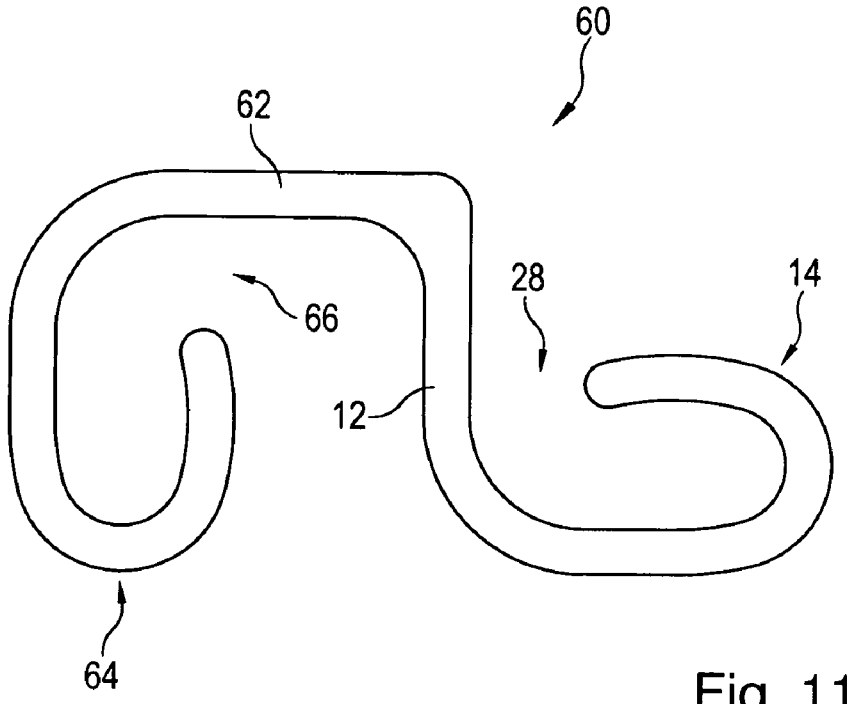
FIG. 11 shows a magnified top view of a front face of a second preferred embodiment of a connection element according to the invention for connecting two light profiles to each other at an angle of 90°.

FIG. 11 shows a top view of a second preferred embodiment of a connection element 60 according to the invention. As is the case with the first preferred embodiment, the hook strip 14 protrudes from a free end of the base strip 12. From the other free end of the base strip 12 of the connection element 10 protrudes from the flat side of the first base strip that points away from the first hook strip 14 a second base strip 62 at an at least approximately right angle. The free end of the second base strip is bent at a right angle and transitions into a second hook strip 64 that is designed at least approximately identical to the first hook strip 14 and that features a jaw 66 that is defined by the flat side of the second base strip 62, whereby the jaw 66 of the second hook strip 64 points toward the flat side of the first base strip 12 that points away from the hook strip 14. Using a connection profile 60, it is possible to connect two light profiles 30 to each other under an angle of 90°.

Figure 12:
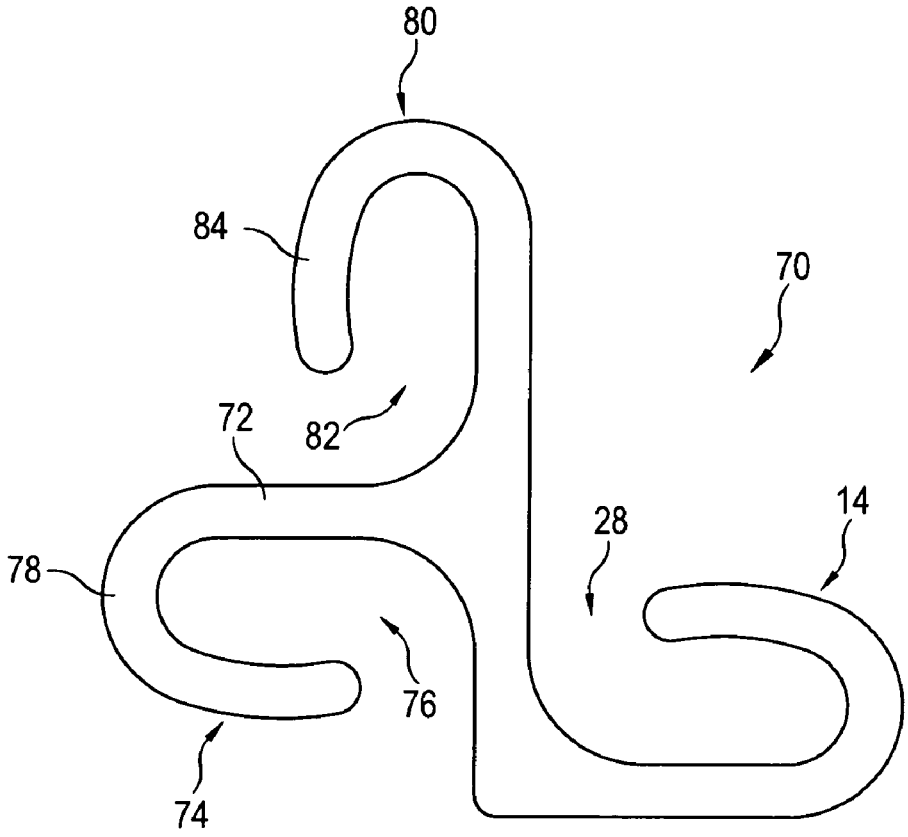
FIG. 12 shows a magnified top view of a front face of a third preferred embodiment of a connection element according to the invention for connecting three light profiles to each other.

FIG. 12 finally shows a third preferred embodiment of a connection element 70 according to the invention for connecting three light profiles 30 to each other. With this third preferred embodiment, a first hook strip 14 protrudes from the free base strip 12 as well. From the flat side of the base strip 12 that points away from the first hook strip 14 protrudes at an at least approximately right angle the connection section 72 of the second hook strip 14 that is designed at least approximately identical to the first hook strip 14 and has a jaw 76 that is defined by the free end for the hook section 78 as well as the base strip 12 that is in common with the first hook strip 14, with the jaw 28 of the first hook strip 14 and the jaw 76 of the second hook strip 74 opening in opposite directions.

In addition, the connection section 72 of the second hook strip 74 is provided at the base strip 12 offset from the connection section 20 of the first hook strip 14 such that the two light profiles 30 that are hung into the two hook strips 14 and 74 run at least approximately in one plane with their differently designed interlocks 32 and 34.

Furthermore, with the connection element 70 shown in FIG. 12, the base strip 14 is extended beyond the connection section 72 of the second hook strip 74 and forms the connection section 78 of a third hook strip 80 that is designed identical to the first and second hook strip 14 and 74. In this case, the jaw 82 of the third hook strip 60 is formed by the free end of its hook section 84 and the flat side of the connection section 72 of the second hook strip 74 that points away from the second hook strip 74.

The preferred embodiments shown in FIGS. 1 to 12 present only a few of the many possibilities to equip a connection element with the hook strip 14 according to the invention. Combinations with other interlock profiles are possible as well such that, for example, Hoesch or Larssen sheet piles can be coupled with light profiles.

Furthermore, the basic shape of the connection element according to the invention can also be adapted to other uses.

What is claimed is:

1. A connection element for light profiles intended for use in a sheet pile wall, said connection element comprising a base strip for attaching to a component of the sheet pile wall and a hook strip attached to one side of the base strip for engaging an interlock of a light profile, wherein the hook strip encloses an inner chamber and exhibits a straight connection section that originates at the base strip and runs at least approximately at a right angle to the longitudinal direction of the base strip, and a hook section that follows the connection section and runs in an arc-like manner for at least 180°, the free end of said hook section together with said one side of the base strip defining a jaw, an improvement wherein a ratio between the greatest inner width (a) of the inner chamber of the hook strip viewed in a direction parallel to a longitudinal direction of the connection section, on the one hand, to the width (c) of a jaw opening between a free end of the hook section and said one side of the base strip, on the other, as viewed in a direction parallel to the longitudinal direction of the connection section, is in a range between 2.6 and 2.9.

2. The connection element of claim 1, wherein the ratio between the greatest inner width (a) of the inner chamber and the width (c) of the jaw opening is approximately 2.75.

3. The connection element of claim 1, wherein a ratio between the material thickness (d) of the hook section viewed perpendicular to the longitudinal direction of the hook section to the greatest width (c) of the jaw is in a range between 0.4 and 0.8.

4. The connection element of claim 1, wherein a ratio between the greatest inner width (a) of the inner chamber to the greatest width (b) of the inner chamber viewed perpendicular to the longitudinal direction of the connection section is in a range between 2.3 and 2.5.

5. The connection element of claim 1, wherein a hook section is formed from a first arc-shaped section that follows directly the connection section and has a uniform small inner curvature radius (R2) and a second arc-shaped section following the first arc-shaped section and exhibiting a uniform inner curvature radius (R3), whereby the ratio between the greater inner curvature radius (R3) to the smaller inner curvature radius (R2) is in a range between 4.1 and 4.4.

6. The connection element of in claim 5, wherein the first arc-shaped section exhibits an arc length having a maximum of 165° and wherein the second arc-shaped section exhibits an arc length having a maximum of 65°.

7. The connection element of in claim 1, wherein the base strip transitions at an inner side that defines the inner chamber into the connection section under formation of a radius (R1), whereby a nominal value of the radius (R1) corresponds at least approximately to a nominal value of the width (c) of the jaw.

8. The connection element of in claim 7, wherein the hook radius (R1) corresponds to 2.0 to 2.5 times the smaller inner curvature radius (R2).

9. The connection element of in claim 1, wherein the connection element is designed as a weld-on profile, where a back side of the base strip that points away from the hook strip serves as a weld-on surface for welding to a component of the sheet pile wall, whereby the weld-on surface at longitudinal edges of the base strip is provided with two weld-on elevations that run parallel to each other and extend across an entire length of the connection element.

10. The connection element of in claim 1, wherein the connection element is designed as a weld-on profile, where from a back side of the base strip that points away from the hook strip protrudes a weld-on strip at an at least approximately right angle.

11. The connection element of in claim 1, wherein at a back side of the base strip that points away from the hook strip is provided an attachment profile for connecting to a component of the sheet pile wall.

12. The connection element of in claim 11, wherein the attachment profile exhibits two holding strips that protrude at an at least approximately right angle from the base strip, between which a fastening section with a rectangular cross-section of the component of the sheet pile wall is to be inserted for attachment purposes.

13. The connection element of in claim 11, wherein a first holding strip that protrudes from the base strip at a specified angle of less than 90° and, at a distance from the first holding strip, a second holding strip that protrudes from the base strip at least approximately at a right angle serve as a fastening profile, between which a fastening section of the component of the sheet pile wall, having a web-shaped cross-section with increasing width toward an outside edge, is to be inserted.

14. The connection element of in claim 1, wherein a second base strip protrudes at least approximately at a right angle from the flat side of the base strip that points away from the first hook strip and where a second hook strip is provided at a free end thereof that is designed at least approximately identical to the first hook strip exhibiting a jaw that is defined by the flat side of the second base strip.

15. The connection element of in claim 14, wherein the one free end of the first base strip transitions into the connection section of the first hook strip, in that the other free end of the first base strip transitions into the second base strip, and in that the jaw of the second hook strip points towards to flat side of the first base strip that points away from the first hook strip.

16. The connection element of in claim 1, wherein the one free end of the first base strip transitions into the connection section of the first hook strip, and wherein a connection section of a second hook strip that is at least approximately identical to the first hook strip protrudes at least approximately at a right angle from the flat side of the base strip that points away from the first hook strip and exhibits a jaw that is defined by the free end of a hook section thereof as well as the base strip that is common with the first hook strip.

17. The connection element of in claim 16, wherein the jaw of the first hook strip and the jaw of the second hooks strip open in opposite directions.

18. The connection element of in claim 17, wherein the connection section of the second hook strip is provided offset versus the connection section of the first hook strip at the first base strip such that the two light profiles that are to be hung into the two hook strips run at least approximately in a common plane.

19. The connection element of in claim 16, wherein the base strip is extended beyond the connection section of the second hook strip and forms the connection section of a third hook strip that is designed identical to the first and the second hook strip, and in that the jaw of the third hook strip is formed by the free end of the hook thereof section as well as the flat side of the connection section of the second hook strip that points away from the second hook strip.

20. The connection element of in claim 1, wherein a support strip protrudes at least approximately at a right angle from said base strip and extends in the same direction as the hook strip, into the jaw of the hook strip.

* * * * *